US005861707A

United States Patent [19]

Kumar

[11] Patent Number: 5,861,707

[45] **Date of Patent: *Jan. 19, 1999**

[54] FIELD EMITTER WITH WIDE BAND GAP EMISSION AREAS AND METHOD OF USING

[75] Inventor: Nalin Kumar, Canyon Lake, Tex.

[73] Assignee: SI Diamond Technology, Inc., Austin, Tex.

[ * ] Notice: The term of this patent shall not extend beyond the expiration date of Pat. No. 5,341,063.

[21] Appl. No.: 482,584

[22] Filed: Jun. 7, 1995

Related U.S. Application Data

[60] Division of Ser. No. 264,386, Jun. 23, 1994, Pat. No. 5,536,193, and a continuation-in-part of Ser. No. 981,958, Nov. 24, 1992, Pat. No. 5,341,063, which is a division of Ser. No. 789,237, Nov. 7, 1991, Pat. No. 5,199,918.

[51] Int. Cl.[6] ..... H01J 1/02; H01J 1/14; H01J 9/02

[52] U.S. Cl. ..... 313/309; 313/355; 257/77; 445/50

[58] Field of Search ..... 313/309, 311, 313/336, 351, 355; 257/77, 78; 315/169.3

[56] References Cited

U.S. PATENT DOCUMENTS

| | | |
|---|---|---|
| 1,954,691 | 4/1934 | de Boer et al. . |
| 2,851,408 | 9/1958 | Cerulli et al. . |
| 2,867,541 | 1/1959 | Coghill et al. . |
| 2,959,483 | 11/1960 | Kaplan . |
| 3,070,441 | 12/1962 | Schwartz . |
| 3,108,904 | 10/1963 | Cusano . |
| 3,259,782 | 7/1966 | Shroff . |
| 3,314,871 | 4/1967 | Heck et al. . |
| 3,360,450 | 12/1967 | Hays . |
| 3,481,733 | 12/1969 | Evans . |
| 3,525,679 | 8/1970 | Wilcox et al. . |
| 3,554,889 | 1/1971 | Hyman et al. . |
| 3,665,241 | 5/1972 | Spindt et al. . |
| 3,675,063 | 7/1972 | Spindt et al. . |
| 3,755,704 | 8/1973 | Spindt et al. . |
| 3,789,471 | 2/1974 | Spindt et al. . |
| 3,808,048 | 4/1974 | Strik . |

(List continued on next page.)

OTHER PUBLICATIONS

Geis, M. W., et al., "Diamond Cold Cathode," *IEEE Electron Device Letters*, vol. 12, No. 8, Aug. 1991, pp. 456–459.

"A new vacuum–etched high–transmittance (antireflection) film," *Appl. Phys. Lett.*, 1980, pp. 727–730.

"A Silicon Field Emitter Array Planar Vacuum FET Fabricated with Microfabrication Techniques," *Mat. Res. Soc. Symp. Proc.*, vol. 76, 1987, pp. 25–30.

"A Technique for Controllable Seeding of Ultrafine Diamond Particles for Growth and Selective–Area Deposition of Diamond Films," *2nd International Conference on the Applications of Diamond Films and Related Materials*, 1993, pp. 475–480.

"Computer Simulations in the Design of Ion Beam Deflection Systems," *Nuclear Instruments and Methods in Physics Research*, vol. B10, No. 11, 1985, pp. 817–821.

"Cone formation as a result of whisker growth on ion bombarded metal surfaces," *J. Vac. Sci. Technol. A*, vol. 3, No. 4, Jul./Aug. 1985, pp. 1821–1834.

(List continued on next page.)

*Primary Examiner*—Ashok Patel
*Assistant Examiner*—Matthew J. Gerike
*Attorney, Agent, or Firm*—Barry S. Newberger; Winstead Sechrest & Minick P.C.

[57] ABSTRACT

A field emitter including an exposed wide band gap emission area in contact with and protruding from a planar surface of a conductive metal, and a method of making is disclosed. Suitable wide band gap materials (2.5–7.0 electron-volts) include diamond, aluminum-nitride and gallium-nitride; suitable conductive metals include titanium, tungsten, gold and graphite. The method includes disposing the wide band gap material on a substrate, disposing the conductive metal on the wide band gap material, and etching the conductive metal to expose wide band gap emission areas. The emission areas are well suited for large area flat panel displays.

16 Claims, 6 Drawing Sheets

U.S. PATENT DOCUMENTS

| | | |
|---|---|---|
| 3,812,559 | 5/1974 | Spindt et al. . |
| 3,855,499 | 12/1974 | Yamada et al. . |
| 3,898,146 | 8/1975 | Rehkopf et al. . |
| 3,947,716 | 3/1976 | Fraser, Jr. et al. . |
| 3,970,887 | 7/1976 | Smith et al. . |
| 3,986,065 | 10/1976 | Pankove ..... 313/355 |
| 3,998,678 | 12/1976 | Fukase et al. . |
| 4,008,412 | 2/1977 | Yuito et al. . |
| 4,075,535 | 2/1978 | Genequand et al. . |
| 4,084,942 | 4/1978 | Villalobos . |
| 4,139,773 | 2/1979 | Swanson . |
| 4,141,405 | 2/1979 | Spindt . |
| 4,143,292 | 3/1979 | Hosokii et al. . |
| 4,164,680 | 8/1979 | Villalobos . |
| 4,168,213 | 9/1979 | Hoeberechts . |
| 4,178,531 | 12/1979 | Alig . |
| 4,307,507 | 12/1981 | Gray et al. . |
| 4,350,926 | 9/1982 | Shelton . |
| 4,482,447 | 11/1984 | Mizuguchi et al. . |
| 4,498,952 | 2/1985 | Christensen . |
| 4,507,562 | 3/1985 | Braunlich et al. . |
| 4,512,912 | 4/1985 | Matsuda et al. . |
| 4,513,308 | 4/1985 | Greene et al. . |
| 4,540,983 | 9/1985 | Morimoto et al. . |
| 4,542,038 | 9/1985 | Odaka et al. . |
| 4,578,614 | 3/1986 | Gray et al. . |
| 4,588,921 | 5/1986 | Tischer . |
| 4,594,527 | 6/1986 | Genevese . |
| 4,633,131 | 12/1986 | Khurgin . |
| 4,647,400 | 3/1987 | Dubroca et al. . |
| 4,663,559 | 5/1987 | Christensen . |
| 4,684,353 | 8/1987 | deSouza . |
| 4,684,540 | 8/1987 | Schulze . |
| 4,685,996 | 8/1987 | Busta et al. . |
| 4,687,825 | 8/1987 | Sagou et al. . |
| 4,687,938 | 8/1987 | Tamura et al. . |
| 4,710,765 | 12/1987 | Ohkoshi et al. . |
| 4,721,885 | 1/1988 | Brodie . |
| 4,728,851 | 3/1988 | Lambe . |
| 4,758,449 | 7/1988 | Kimura et al. . |
| 4,763,187 | 8/1988 | Biberian . |
| 4,780,684 | 10/1988 | Kosmahl . |
| 4,788,472 | 11/1988 | Katakami . |
| 4,816,717 | 3/1989 | Harper et al. . |
| 4,818,914 | 4/1989 | Brodie . |
| 4,822,466 | 4/1989 | Rabalais et al. . |
| 4,827,177 | 5/1989 | Lee et al. . |
| 4,835,438 | 5/1989 | Baptist et al. . |
| 4,851,254 | 7/1989 | Yamamoto et al. . |
| 4,855,636 | 8/1989 | Busta et al. . |
| 4,857,161 | 8/1989 | Borel et al. . |
| 4,857,799 | 8/1989 | Spindt et al. . |
| 4,874,981 | 10/1989 | Spindt . |
| 4,882,659 | 11/1989 | Gloudemans . |
| 4,889,690 | 12/1989 | Lubbers et al. . |
| 4,892,757 | 1/1990 | Kasenga et al. . |
| 4,899,081 | 2/1990 | Kishino et al. . |
| 4,900,584 | 2/1990 | Tuenge et al. . |
| 4,908,539 | 3/1990 | Meyer . |
| 4,923,421 | 5/1990 | Brodie et al. . |
| 4,926,056 | 5/1990 | Spindt . |
| 4,933,108 | 6/1990 | Soredal . |
| 4,940,916 | 7/1990 | Borel et al. . |
| 4,943,343 | 7/1990 | Bardai et al. . |
| 4,956,202 | 9/1990 | Kasenga et al. . |
| 4,956,573 | 9/1990 | Kane . |
| 4,964,946 | 10/1990 | Gray et al. . |
| 4,987,007 | 1/1991 | Wagal et al. . |
| 4,990,416 | 2/1991 | Mooney . |
| 4,990,766 | 2/1991 | Simms et al. . |
| 4,994,205 | 2/1991 | Towers . |
| 5,007,873 | 4/1991 | Goronkin et al. . |
| 5,015,912 | 5/1991 | Spindt et al. . |
| 5,019,003 | 5/1991 | Chason . |
| 5,036,247 | 7/1991 | Watanabe et al. . |
| 5,038,070 | 8/1991 | Bardai et al. . |
| 5,043,715 | 8/1991 | Kun et al. . |
| 5,054,046 | 10/1991 | Shoulders . |
| 5,054,047 | 10/1991 | Shoulders . |
| 5,055,077 | 10/1991 | Kane . |
| 5,055,744 | 10/1991 | Tsuruoka . |
| 5,057,047 | 10/1991 | Greene et al. . |
| 5,063,323 | 11/1991 | Longo et al. . |
| 5,063,327 | 11/1991 | Brodie et al. . |
| 5,064,396 | 11/1991 | Spindt . |
| 5,066,883 | 11/1991 | Yoshioka et al. . |
| 5,075,591 | 12/1991 | Holmberg . |
| 5,075,595 | 12/1991 | Kane . |
| 5,075,596 | 12/1991 | Young et al. . |
| 5,079,476 | 1/1992 | Kane . |
| 5,085,958 | 2/1992 | Jeong . |
| 5,089,292 | 2/1992 | MaCaulay et al. . |
| 5,089,742 | 2/1992 | Kirkpatrick et al. . |
| 5,089,812 | 2/1992 | Fuse . |
| 5,090,932 | 2/1992 | Dieumegard et al. . |
| 5,098,737 | 3/1992 | Collins et al. . |
| 5,101,137 | 3/1992 | Kun et al. . |
| 5,101,288 | 3/1992 | Ohta et al. . |
| 5,103,144 | 4/1992 | Dunham . |
| 5,103,145 | 4/1992 | Doran . |
| 5,117,267 | 5/1992 | Kimoto et al. . |
| 5,117,299 | 5/1992 | Kondo et al. . |
| 5,119,386 | 6/1992 | Narusawa . |
| 5,123,039 | 6/1992 | Shoulders . |
| 5,124,072 | 6/1992 | Dole et al. . |
| 5,124,558 | 6/1992 | Soltani et al. . |
| 5,126,287 | 6/1992 | Jones . |
| 5,129,850 | 7/1992 | Kane et al. . |
| 5,132,585 | 7/1992 | Kane et al. . |
| 5,132,676 | 7/1992 | Kimura et al. . |
| 5,136,764 | 8/1992 | Vasquez . |
| 5,138,237 | 8/1992 | Kane et al. . |
| 5,140,219 | 8/1992 | Kane . |
| 5,141,459 | 8/1992 | Zimmerman . |
| 5,141,460 | 8/1992 | Jaskie et al. . |
| 5,142,184 | 8/1992 | Kane . |
| 5,142,256 | 8/1992 | Kane . |
| 5,142,390 | 8/1992 | Ohta et al. . |
| 5,144,191 | 9/1992 | Jones et al. . |
| 5,148,078 | 9/1992 | Kane . |
| 5,148,461 | 9/1992 | Shoulders . |
| 5,150,011 | 9/1992 | Fujieda . |
| 5,150,192 | 9/1992 | Greene et al. . |
| 5,151,061 | 9/1992 | Sandhu . |
| 5,153,753 | 10/1992 | Ohta et al. . |
| 5,153,901 | 10/1992 | Shoulders . |
| 5,155,420 | 10/1992 | Smith . |
| 5,156,770 | 10/1992 | Wetzel et al. . |
| 5,157,304 | 10/1992 | Kane et al. . |
| 5,157,309 | 10/1992 | Parker et al. . |
| 5,162,704 | 11/1992 | Kobori et al. . |
| 5,166,456 | 11/1992 | Masahiko . |
| 5,173,634 | 12/1992 | Kane . |
| 5,173,635 | 12/1992 | Kane . |
| 5,173,697 | 12/1992 | Smith et al. . |
| 5,180,951 | 1/1993 | Dworsky et al. . |
| 5,183,529 | 2/1993 | Potter et al. . |
| 5,185,178 | 2/1993 | Koskenmaki . |
| 5,186,670 | 2/1993 | Doan et al. . |
| 5,187,578 | 2/1993 | Kohgami et al. . |
| 5,191,217 | 3/1993 | Kane et al. . |
| 5,192,240 | 3/1993 | Komatsu . |

| | | |
|---|---|---|
| 5,194,780 | 3/1993 | Meyer . |
| 5,199,917 | 4/1993 | MacDonald et al. . |
| 5,199,918 | 4/1993 | Kumar . |
| 5,201,992 | 4/1993 | Marcus et al. . |
| 5,202,571 | 4/1993 | Hinabayashi et al. . |
| 5,203,731 | 4/1993 | Zimmerman . |
| 5,204,021 | 4/1993 | Dole . |
| 5,204,581 | 4/1993 | Andreadakis et al. . |
| 5,205,770 | 4/1993 | Lowrey et al. . |
| 5,209,687 | 5/1993 | Konishi . |
| 5,210,430 | 5/1993 | Taniguchi et al. . |
| 5,210,462 | 5/1993 | Konishi . |
| 5,212,426 | 5/1993 | Kane . |
| 5,213,712 | 5/1993 | Dole . |
| 5,214,346 | 5/1993 | Komatsu . |
| 5,214,347 | 5/1993 | Gray . |
| 5,214,416 | 5/1993 | Kondo et al. . |
| 5,220,725 | 6/1993 | Chan et al. . |
| 5,227,699 | 7/1993 | Busta . |
| 5,228,877 | 7/1993 | Allaway et al. . |
| 5,228,878 | 7/1993 | Komatsu . |
| 5,229,331 | 7/1993 | Doan et al. . |
| 5,229,682 | 7/1993 | Komatsu . |
| 5,231,606 | 7/1993 | Gray . |
| 5,232,549 | 8/1993 | Cathey et al. . |
| 5,233,263 | 8/1993 | Cronin et al. . |
| 5,235,244 | 8/1993 | Spindt . |
| 5,236,545 | 8/1993 | Pryor . |
| 5,242,620 | 9/1993 | Dole et al. . |
| 5,243,252 | 9/1993 | Kaneko et al. . |
| 5,250,451 | 10/1993 | Chouan . |
| 5,252,833 | 10/1993 | Kane et al. . |
| 5,256,888 | 10/1993 | Kane . |
| 5,259,799 | 11/1993 | Doan et al. . |
| 5,262,698 | 11/1993 | Dunham . |
| 5,266,155 | 11/1993 | Gray . |
| 5,275,967 | 1/1994 | Taniguchi et al. . |
| 5,276,521 | 1/1994 | Mori et al. . |
| 5,277,638 | 1/1994 | Lee . |
| 5,278,475 | 1/1994 | Jaskie et al. . |
| 5,281,890 | 1/1994 | Kane . |
| 5,281,891 | 1/1994 | Kaneko et al. . |
| 5,283,500 | 2/1994 | Kochanski . |
| 5,285,129 | 2/1994 | Takeda et al. . |
| 5,296,117 | 3/1994 | De Jaeger et al. . |
| 5,300,862 | 4/1994 | Parker et al. . |
| 5,302,423 | 4/1994 | Tran et al. . |
| 5,308,439 | 5/1994 | Cronin et al. . |
| 5,312,514 | 5/1994 | Kumar . |
| 5,312,777 | 5/1994 | Cronin et al. . |
| 5,315,393 | 5/1994 | Mican . |
| 5,329,207 | 7/1994 | Cathey et al. . |
| 5,330,879 | 7/1994 | Dennison . |
| 5,341,063 | 8/1994 | Kumar . |
| 5,347,201 | 9/1994 | Liang et al. . |
| 5,347,292 | 9/1994 | Ge et al. . |
| 5,357,172 | 10/1994 | Lee et al. . |
| 5,368,681 | 11/1994 | Hiraoka et al. . |
| 5,378,963 | 1/1995 | Ikeda . |
| 5,380,546 | 1/1995 | Kirshnan et al. . |
| 5,387,844 | 2/1995 | Browning . |
| 5,393,647 | 2/1995 | Neukermans et al. . |
| 5,396,150 | 3/1995 | Wu et al. . |
| 5,399,238 | 3/1995 | Kumar . |
| 5,401,676 | 3/1995 | Lee . |
| 5,402,041 | 3/1995 | Kishino et al. . |
| 5,404,070 | 4/1995 | Tsai et al. . |
| 5,408,161 | 4/1995 | Kishino et al. . |
| 5,410,218 | 4/1995 | Hush . |
| 5,412,285 | 5/1995 | Komatsu . |

OTHER PUBLICATIONS

"Cone Formation on Metal Targets During Sputtering," *J. Appl. Physics*, vol. 42, No. 3, Mar. 1, 1971, pp. 1145–1149.

"Control of silicon field emitter shape with isotrophically etched oxide masks," *Inst. Phys. Conf. Ser. No. 99: Section 2,* Presented at 2nd Int. Conf. on Vac. Microelectron, Bath, 1989, pp. 37–40.

"Deposition of diamond–like carbon," *Phil. Trans. R. Soc. Land. A*, vol. 342, 1993, pp. 277–286.

"Fabrication of gated silicon field–emission cathodes for vacuum microelectronics and electron–beam applications," *J. Vac. Sci. Technol. B*, vol. 11, No. 2, Mar./Apr. 1993, pp. 454–458.

"Fabrication of silicon field emission points for vacuum microelectronics by wet chemical etching," *Semicond. Sci. Technol.*, vol. 6, 1991, pp. 223–225.

"Fabrication of 0.4 $\mu$m grid apertures for field–emission array cathodes," *Microelectronic Engineering*, vol. 21, 1993, pp. 467–470.

"Growth of diamond particles on sharpened silicon tips," *Materials Letters*, vol. 18, No. 1.2, 1993, pp. 61–63.

"Interference and diffraction in globular metal films," *J. Opt. Soc. Am.*, vol. 68, No. 8, Aug. 1978, pp. 1023–1031.

"Oxidation sharpening of silicon tips," *J. Vac. Sci. Technol. B*, vol. 9, No. 6, Nov./Dec. 1991, pp. 2733–2737.

"Physical properties of thin film field emission cathodes with molybdenum cones," *Journal of Applied Physics*, vol. 47, No. 12, 1976, pp. 5248–5263.

"Recent Progress in Low–Voltage Field–Emission Cathode Development," *Journal de Physique*, Colloque C9, supp. au No. 12, Tome 45, Dec. 12984, pp. C9–269–278.

"The influence of surface treatment on field emission from silicon microemitters," *J. Phys.: Condens. Matter*, vol. 3, 1991, pp. S231–S236.

"Topography: Texturing Effects," *Handbook of Ion Beam Processing Technology*, Chapter 17, pp. 338–361.

"Ultrasharp tips for field emission applications prepared by the vapor–liquid–solid growth technique," *J. Vac. Sci. Technol. B*, vol. 11, No. 2, Mar./Apr. 1993, pp. 449–453.

"A Comparative Study of Deposition of Thin Films by Laser Induced PVD with Femtosecond and Nanosecond Laser Pulses," *SPIE*, vol. 1858, 1993, pp. 464–475.

"Amorphic diamond films produced by a laser plasma source," *J. Appl. Physics*, vol. 67, No. 4, Feb. 15, 1990, pp. 2018–2087.

"Characterization of laser vaporization plasmas generated for the deposition of diamond–like carbon," *J. Appl. Phys.*, vol. 72, No. 9, Nov. 1, 1992, pp. 3966–3970.

"Cold Field Emission From CVD Diamond Films Observed in Emission Electron Microscopy," Dept. of Physics & Astronomy & the Condensed Matter & Surface Science Program, Ohio University, Athens, Ohio, Jun. 10, 1991.

"Current Display Research—A Survey," Zenith Radio Corporation.

"Deposition of Amorphous Carbon Films from Laser–Produced Plasmas," *Mat. Res. Soc. Sump. Proc.*, vol. 38, 1985, pp. 326–335.

"Development of Nano–Crystaline Diamond–Based Field–Emissions Displays," *SID 94Digest*, 1994, pp. 43–45.

"Diamond Cold Cathode," *IEEE Electron Device Letters*, vol. 12, No. 8, Aug. 1991, pp. 456–459.

"Diamond–like carbon films prepared with a laser ion source," *Appl. Phys. Lett.*, vol. 53, No. 3, 18 Jul. 1988, pp. 187–188.

"Direct Observation of Laser–Induced Crystallization of a–C:H Films," *Appl. Phys. A*, vol.58, 1994, pp. 137–144.

"Emission spectroscopy during excimer laser ablation of graphite," *Appl. Phys. Letters*, vol. 57, No. 21, 19 Nov. 1990, pp. 2178–2180.

"Enhanced cold–cathode emission using composite resin–carbon coatings," Dept. of Electronic Eng. & Applied Physics, Aston Univ., Aston Triangle, Birmingham, UK, 29 May 1987.

"High Temperature Chemistry in Laser Plumes," *John L. Margrave Research Symposium*, Rice University, Apr. 29, 1994.

"Imaging and Characterization of Plasma Plumes Produced During Laser Ablation of Zirconium Carbide," D.P. Butt and P.J. Wantuck, *Materials Research Society Symposium Proceedings*, vol. 285, pp. 81–86 (Laser Ablation in Materials Processing: Fundamentals and Applications—symposium held Dec. 1–4, 1992, Boston, Mass.).

"Laser–Assisted Selective Area Metallization of Diamond Surface by Electroless Nickel Plating," *2nd International Conference on the Applications of Diamond Films and Related Materials*, 1993, pp. 303–306.

"Laser plasma source of amorphic diamond," *Appl. Phys. Lett.*, vol. 54, No. 3, Jan. 16, 1989, pp. 216–218.

"Optical characterization of thin film laser deposition processes," *SPIE*, vol. 1594, Process Module Metrology, Control, and Clustering, 1991, pp. 411–417.

"Optical Emission Diagnostics of Laser–Induced Plasma for Diamond–like Film Deposition," *Applied Physics A—Solids and Surfaces*, vol. 52, 1991, pp. 328–334.

"Optical observation of plumes formed at laser ablation of carbon materials," *Applied Surface Science*, vol. 79/80, 1994, pp. 141–145.

"Spatial characteristics of laser pulsed plasma deposition of thin films," *SPIE*, vol. 1352, Laser Surface Microprocessing, 1989, pp. 95–99.

"Species Temporal and Spatial Distributions in Laser Ablation Plumes," J.W. Hastie, et al., *Materials Research Society Symposium Proceedings*, vol. 285, pp. 39–44 (Laser Ablation in Materials Processing: Fundamentals and Applications—symposium held Dec. 1–4, 1992, Boston, Mass.).

"The bonding of protective films of amorphic diamond to titanium," *J. Appl. Phys.*, vol. 71, No. 7, 1 Apr. 1992, pp. 3260–3265.

"Thermochemistry of materials by laser vaporization mass spectrometry: 2. Graphite," *High Temperatures — High Pressures*, vol. 20, 1988, pp. 73–89.

"A Comparison of the Transmission Coefficient and the Wigner Function Approaches to Field Emission," *COMPEL*, vol. 11, No. 4, 1992, pp. 457–470.

"A New Model for the Replacement Process in Electron Emission at High Fields and Temperatures," Dept. of Physics, The Penn. State Univ., University Park, PA.

"Angle–resolved photoemission of diamond (111) and (100) surfaces; negative electron affinity and band structure measurements," *J. Vac. Sci. Technol. B*, vol. 12, No. 4, Jul./Aug. 1994, pp. 2475–2479.

"Angular Characteristics of the Radiation by Ultra Relativistic Electrons in Thick Diamond Single Crystals," *Sov. Tech. Phys. Lett.*, vol. 11, No. 11, Nov. 1985, pp. 574–575.

"Argon and hydrogen plasma interactions on diamond (111) surfaces: Electronic states and structure," *Appl. Phys. Lett.*, vol. 62, No. 16, 19 Apr. 1993, pp. 1878–1880.

"A Theoretical Study on Field Emission Array for Microsensors," *IEEE Transactions on Electron Devices*, vol. 39, No. 2, Feb. 1992, pp. 313–324.

"A Wide–Bandwidth High–Gain Small–Size Distributed Amplifier with Field–Emission Triodes (FETRODE's) for the 10 to 300 GHz Frequency Range," *IEEE Transactions on Electron Devices*, vol. 36, No. 11, Nov. 1989, pp. 2728–2737.

"Capacitance–Voltage Measurements on Metal–$SiO_2$–Diamond Structures Fabricated with (100)–and (111)–Oriented Substrates," *IEEE Transactions on Electron Devices*, vol. 38, No. 3, Mar. 1991, pp. 619–626.

"Characterisation of the Field Emitting Properties of CVD Diamond Films," *Conference Record—1994 Tri–Service/NASA Cathode Workshop*, Cleveland, Ohio, Mar. 29–31, 1994, pp. 91–94.

"Collector–Assisted Operation of Micromachined Field–Emitter Triodes," *IEEE Transactions on Electron Devices*, vol. 40, No. 8, Aug. 1993, pp. 1537–1542.

"Collector–Induced Field Emission Triode," *IEEE Transactions on Electron Devices*, vol. 39, No. 11, Nov. 1992, pp. 2616–2620.

"Diamond–based field emission flat panel displays," *Solid State Technology*, May 1995, pp. 71–74.

"Diamond Cold Cathodes: Applications of Diamond Films and Related Materials," Elsevier Science Publishers BN, 1991, pp. 309–310.

"Diamond Field–Emission Cathodes," *Conference Record—1994 Tri–Service/NASA Cathode Workshop,* Cleveland, Ohio, Mar. 29–31, 1994.

"Diamond Field–Emission Cathode Technology," Lincoln Laboratory @ MIT.

"Diamond–like nanocomposites (DLN)," *Thin Solid Films*, vol. 212, 1992, pp. 267–273.

"Diamond–like nanocomposites: electronic transport mechanisms and some applications," *Thin Solid Films*, vol. 212, 1992, pp. 274–281.

"Electrical characterization of gridded field emission arrays," *Inst. Phys. Conf. Ser. No. 99: Section 4* Presented at 2nd Int. Conf. on Vac. Microelectron., Bath, 1989, pp. 81–84.

"Electrical phenomena occurring at the surface of electrically stressed metal cathodes. I. Electroluminescence and breakdown phenomena with medium gap spacings (2–8 mm)," *J. Phys. D: Appl. Phys.*, vol. 12, 1979, pp. 2229–2245.

"Electrical phenomena occurring at the surface of electrically stressed metal cathodes. II. Identification of electroluminescent (k–spot) radiation with electron emission on broad area cathodes," *J. Phys. D: Appl. Phys.*, vol. 12, 1979, pp. 2247–2252.

"Electroluminescence produced by high electric fields at the surface of copper cathodes," *J. Phys. D: Appl. Phys.*, vol. 10, 1977, pp. L195–201.

"Electron emission from phosphorus–and boron–doped polycrystalline diamond films," *Electronics Letters*, vol. 31, No. 1, Jan. 1995, pp. 74–75.

"Electron Field Emission from Amorphic Diamond Thin Films," *6th International Vacuum Microelectronics Conference Technical Digest*, 1993, pp. 162–163.

"Electron Field Emission from Broad–Area Electrodes," *Applied Physics A—Solids and Surfaces*, vol. 28, 1982, pp. 1–24.

"Emission characteristics of metal–oxide–semiconductor electron tunneling cathode," *J. Vac. Sci. Technol. B*, vol. 11, No. 2, Mar./Apr. 1993, pp. 429–432.

"Emission Characteristics of Silicon Vacuum Triodes with Four Different Gate Geometries," *IEEE Transactions on Electron Devices*, vol. 40, No. 8, Aug. 1993, pp. 1530–1536.

"Emission Properties of Spindt–Type Cold Cathodes with Different Emission Cone Material", *IEEE Transactions on Electron Devices*, vol. 38, No. 10, Oct. 1991.

"Energy exchange processes in field emission from atomically sharp metallic emitters," *J. Vac. Sci. Technol. B*, vol. 11, No. 2, Mar./Apr. 1993, pp. 366–370.

"Enhanced Cold–Cathode Emission Using Composite Resin–Carbon Coatings," Dept. of Electronic Eng. & Applied Phiscs, Aston Univ., Aston Triangle, Birmingham, UK, May 29, 1987.

"Experimental and theoretical determinations of gate–to–emitter stray capacitances of field emitters," *J. Vac. Sci. Technol. B*, vol. 11, No. 2, Mar./Apr. 1993, pp. 445–448.

"Fabrication and Characterization of Lateral Field–Emitter Triodes," *IEEE Transactions on Electron Devices*, vol. 38, No. 10, Oct. 1991, pp. 2334–2336.

"Field–Dependence of the Area–Density of 'Cold' Electron Emission Sites on Broad–Area CVD Diamond Films," *Electronics Letters*, vol. 29, No. 18, 2 Sep. 1993, pp. 1596–1597.

"Field Electron Energy Distributions for Atomically Sharp Emitters," The Penn. State Univ., University Park, PA.

*Field Emission and Field Ionization*, "Theory of Field Emission" (Chapter 1) and Field–Emission Microscopy and Related Topics (Chapter 2), *Harvard Monographs in Applied Science*, No. 9, Harvard University Press, Cambridge, Mass., 1961, pp. 1–63.

"Field Emission Cathode Technology and It's [sic] Applications," *Technical Digest of IVMC 91*, Nagahama, 1991, pp. 40–43.

"Field Emission Characteristics Requirements for Field Emission Displays," *Conf. of 1994 Int. Display Research Conf. and Int. Workshops on Active–Matrix LCDs & Display Mat'ls*, Oct. 1994.

"Field emission device modeling for application to flat panel displays," *J. Vac. Sci. Technol. B*, vol. 11, No. 2, Mar./Apr. 1993, pp. 518–522.

"Field Emission Displays Based on Diamond Thin Films," *Society of Information Display Conference Technical Digest*, 1993, pp. 1009–1010.

"Field emission from silicon through an adsorbate layer," *J. Phys.: Condens. Matter*, vol. 3, 1991, pp. S187–S192.

"Field Emission from Tungsten–Clad Silicon Pyramids," *IEEE Transactions on Electron Devices*, vol. 36, No. 11, Nov. 1989, pp. 2679–2685.

"Field Emission Measurements with $\mu$m Resolution on CVD–Polycrystalline Diamond Films," To be published and presented at the *8th IVMC '95*, Portland, Oregon.

"Field–emitter–array development for high–frequency operation," *J. Vac. Sci. Technol. B*, vol. 11, No. 2, Mar./Apr. 1993, pp. 468–473.

"Field Emitter Arrays Applied to Vacuum Fluorescent Display," *Journal de Physique*, Colloque C6, supp. au No. 11, Tome 49, Nov. 1988, pp. C6–153–154.

"Field Emitter Arrays—More Than A Scientific Curiosity?" *Colloque de Physique*, Colloque C8, supp. au No. 11, Tome 50, Nov. 1989, pp. C8–67–72.

"Field Emitter Array with Lateral Wedges," *Technical Digest of IVMC 91*, Nagahama, 1991, pp. 50–51.

"Field emitter tips for vacuum microelectronic devices," *J. Vac. Sci. Technol. A*, vol. 8, No. 4, Jul./Aug. 1990, pp. 3586–3590.

"Field–induced electron emission through Langmuir–Blodgett multiplayers," Dept. of Electrical and Electronic Engineering and Applied Physics, Aston Univ., Birmingham, UK, Sep. 1987 (0022–3727/88/010148+06).

"Field–Induced Photoelectron Emission from p–Type Silicon Aluminum Surface–Barrier Diodes," *Journal of Applied Physics*, vol. 41, No. 5, Apr. 1970, pp. 1945–1951.

"Flat–Panel Displays," *Scientific American*, Mar. 1993, pp. 90–97.

"Gated Field Emitter Failures: Experiment and Theory," *IEEE Transactions on Plasma Science*, vol. 20, No. 5, Oct. 1992, pp. 499–506.

"High–resolution simulation of field emission," *Nuclear Instruments and Methods in Physics Research* A298, 1990, pp. 39–44.

"Ion–space–charge initiation of gated field emitter failure," *J. Vac. Sci. Technol. B*, vol. 11, No. 2, Mar./Apr. 1993, pp. 441–444.

"Low–energy electron transmission and secondary–electron emission experiments on crystalline and molten long–chain alkanes," *Physical Review B*, vol. 34, No. 9, 1 Nov. 1986, pp. 6386–6393.

"Low Energy Electron Transmission Measurements on Polydiacetylene Langmuir–Blodgett Films," *Thin Solid Films*, vol. 179, 1989, pp. 327–334.

Measurement of gated field emitter failures, *Rev. Sci. Instrum.*, vol. 64, No. 2, Feb. 1993, pp. 581–582.

"Metal–Film–Edge Field Emitter Array with a Self–Aligned Gate," *Technical Digest of IVMC 91*, Nagahama, 1991, pp. 46–47.

"Microstructural Gated Field Emission Sources for Electron Beam Applications," *SPIE*, vol. 1671, 1992, pp. 201–207.

"Microstructure of Amorphic Diamond Films," The Univ. of Texas at Dallas, Center for Quantum Electronics, Richardson, Texas.

"Microtip Field–Emission Display Performance Considerations," *SID 92 Digest*, pp. 523–526.

"Monoenergetic and Directed Electron Emission from a Large–Bandgap Organic Insulator with Negative Electron Affinity," *Europhysics Letters*, vol. 5, No. 4, 1988, pp. 375–380.

"Monte Carlo Simulation of Ballistic Charge Transport in Diamond under an Internal Electric Field," Dept. of Physics, The Penn. State Univ., University Park, PA, Mar. 3, 1995.

"Negative Electron Affinity and Low Work Function Surface: Cesium on Oxygenated Diamond (100)," *Physical Review Letters*, vol. 73, No. 12, 19 Sep. 1994, pp. 1664–1667.

"Numerical simulation of field emission from silicon," *J. Vac. Sci. Technol. B*, vol. 11, No. 2, Mar./Apr. 1993, pp. 371–378.

"Optical Recording in Diamond–Like Carbon Films," *JJAP Series 6, Proc. Int. Symp. on Optical Memory*, 1991, pp. 116–120.

"Optimization of Amorphic Diamond™ for Diode Field Emission Displays," Microelectronics and Computer Technology Corporation and SI Diamond Technology, Inc.

"Planer [sic] Field Emission Devices with Three–Dimensional Gate Structures," *Technical Digest of IVMC 91*, Nagahama 1991, pp. 78–79.

"Real–time, in situ photoelectron emission microscopy observation of CVD diamond oxidation and dissolution on molybdenum," *Diamond and Related Materials*, vol. 3, 1994, pp. 1066–1071.
"Recent Development on 'Microtips' Display at LETI," *Technical Digest of IVMC 91*, Nagahama, 1991, pp. 6–9.
"Schottky barrier height and negative electron affinity of titanium on (111) diamond," *J. Vac. Sci. Technol. B*, vol. 10, No. 4, Jul./Aug. 1992, pp. 1940–1943.
"Sealed Vacuum Devices: Microchips Fluorescent Display," *3rd International Vacuum Microelectronics Conference*, Monterrey, U.S.A., Jul. 1990.
"Silicon Field Emitter Arrays for Cathodoluminescent Flat Panel Displays," CH–3071–8/91/0000–0141, 1991 IEEE.
"Simulation of Field Emission from Silicon: Self–Consistent Corrections Using the Wigner Distribution Function," *COMPEL*, vol. 12, No. 4, 1993, pp. 507–515.
"Single micromachined emitter characteristics," *J. Vac. Sci. Technol. B*, vol. 11, No. 2, Mar./Apr. 1993, pp. 396–399.
"Stability of the emission of a microtip," *J. Vac. Sci. Technol. B*, vol. 12, No. 2, Mar./Apr. 1994, pp. 685–688.
"Structure and Electrical Characteristics of Silicon Field–Emission Microelectronic Devices," *IEEE Transactions on Electron Devices*, vol. 38, No. 10, Oct. 1991, pp. 2309–2313.
"Substrate and Target Voltage Effects on Sputtered Hydrogenated Amorphous Silicon," *Solar Energy Materials*, vol. 11, 1985, pp. 447–454.
"Synchrotron radiation photoelectron emission microscopy of chemical–vapor–deposited diamond electron emitters", *J. Vac. Sci. Technol. A*, vol. 13, No. 3, May/Jun. 1995, pp. 1–5.
"Temperature dependence of I–V characteristics of vacuum triodes from 24 to 300 K," *J. Vac Sci. Technol. B*, vol. 11, No. 2, Mar./Apr. 1993, pp. 400–402.
"The Field Emission Display: A New Flat Panel Technology," CH–3071–8/91/0000–0012 501.00 © 1991 IEEE.
"The nature of field emission sites," *J. Phys. D: Appl. Phys.*, vol. 8, 1975, pp. 2065–2073.
"Theoretical study of field emission from diamond," *Appl. Phys. Lett.*, vol. 65, No. 20, 14 Nov. 1994, pp. 2562–2564.
"Theory of electron emission in high fields from atomically sharp emitters: Validity of the Fowler–Nordheim equation," *J. Vac. Sci. Technol. B*, vol. 11, No. 2, Mar./Apr. 1993, pp. 387–391.
"The Semiconductor Field–Emission Photocathode," *IEEE Transactions on Electron Devices*, vol. ED–21, No. 12, Dec. 1974, pp. 785–797.
"The SIDT/MCC Amorphic Diamond Cathode Field Emission Display Technology," *David Sarnoff Research Center—Client Study*, Mar. 1994.
"The source of high–β electron emission sites on broad–area high–voltage alloy electrodes," *J. Phys. D: Appl. Phys.*, vol. 12, 1979, pp. 969–977.
"Thin–Film Diamond," *The Texas Journal of Science*, vol. 41, No. 4, 1989, pp. 343–358.
"Thin Film Emitter Development," *Technical Digest of IVMC* 91, Nagahama, 1991, pp. 118–119.
"Triode characteristics and vacuum considerations of evaporated silicon microdevices," *J. Vac. Sci. Technol. B*, vol. 11, No. 2, Mar./Apr. 1993, pp. 422–425.
"Tunnelling theory and vacuum microelectronics," *Inst. Phys. Conf. Ser. No. 99: Section 5*, Presented at 2nd Int. Conf. on Vac. Microelectron., Bath, 1989, pp. 121–131.
"Ultrahigh–vacuum field emitter array wafer tester," *Rev. Sci. Instrum.*, vol. 58, No. 2, Feb. 1987, pp. 301–304.
"Use of Diamond Thin Films for Low Cost field Emissions Displays," *7th International Vacuum Microelectronics Conference Technical Digest*, 1994, pp. 229–232.
"Vacuum microtriode characteristics," *J. Vac. Sci. Technol. A*, vol. 8, No. 4, Jul./ Aug. 1990, pp. 3581–3585.
"Wedge–Shaped Field Emitter Arrays for Flat Display," *IEEE Transactions on Electron Devices*, vol. 38, No. 10, Oct. 1991, pp. 2395–2397.
*Cathodoluminescence: Theory and Application*, Chapters 9 and 10, VCH Publishers, New York, NY, 1990.
"Cathodoluminescent Materials," *Electron Tube Design, D. Sarnoff Res. Center Yearly Reports & Review*, 1976, pp. 128–137.
"Electron Microscopy of Nucleation and Growth of Indium and Tin Films," *Philosophical Magazine*, vol. 26, No. 3, 1972, pp. 649–663.
"Improved Performance of Low Voltage Phosphors for Field Emission Displays," *SID Display Manufacturing Conf.*, Santa Clara, CA, Feb. 2, 1995.
"Phosphor Materials for Cathode–Ray Tubes," *Advances in Electronics and Electron Physics*, vol. 17, 1990, pp. 271–351.
"Phosphors and Screens," *Advances in Electronics and Electron Physics*, vol. 67, 1990, Academic Press Inc., 1986, pp. 254, 272–273.
"The Chemistry of Artificial Lighting Devices—Lamps, Phosphors and Cathode Ray Tubes," *Studies in Inorganic Chemistry 17*, Elsevier Science Publishers B.V., The Netherlands, 1993, pp. 573–593.
Data Sheet on Anode Drive SN755769, Texas Instruments, pp. 4–18 to 4–88.
Data Sheet on Display Driver, HV38, Supertex, Inc., pp. 11–43 to 11–50.
Data Sheet on Voltage Driver, HV620, Supertex Inc., pp. 1–6, May 21, 1993.
Data Sheet on Voltage Drive, HV 622, Supertex Inc., pp. 1–5, Sep. 22, 1992.
"Light scattering from aggregated silver and gold films," *J. Opt. Soc. Am.*, vol. 64, No. 9, Sep. 1974, pp. 1190–1193.

FIELD EMITTER WITH WIDE BAND GAP EMISSION AREAS AND METHOD OF USING

CROSS-REFERENCE TO RELATED APPLICATIONS

This is a division of application Ser. No. 08/264,386 filed Jun. 23, 1994, now U.S. Pat. No. 5,536,193, and is a continuation-in-part of U.S. application Ser. No. 07/981,958 filed Nov. 24, 1992, issued as U.S. Pat. No. 5,341,063; which is a divisional of U.S. application Ser. No. 07/789,237 filed Nov. 7, 1991, issued as U.S. Pat. No. 5,199,918. Such applications and the disclosures therein are incorporated by reference.

BACKGROUND OF THE INVENTION

1. Field of the Invention

The invention relates to field emitters, and more particularly to exposed wide band gap field emission areas and a method of making same.

2. Description of Related Art

Field emitters are widely used as sources of electrons in lamps and scanning electron microscopes since emission is affected by the adsorbed materials. Field emitters have also been found useful in flat panel displays and vacuum microelectronics applications. Cold cathode and field emission based flat panel displays have several advantages over other types of flat panel displays, including low power dissipation, high intensity and low projected cost. Thus, an improved field emitter and any process which reduces the complexity of fabricating field emitters is clearly useful.

The present invention can be better appreciated with an understanding of the related physics. General electron emission can be analogized to the ionization of a free atom. Prior to ionization, the energy of electrons in an atom is lower than electrons at rest in a vacuum. In order to ionize the atom, energy must be supplied to the electrons in the atom. That is, the atom fails to spontaneously emit electrons unless the electrons are provided with energy greater than or equal to the electrons at rest in the vacuum. Energy can be provided by numerous means, such as by heat or irradiation with light. When sufficient energy is imparted to the atom, ionization occurs and the atom releases one or more electrons.

Several types of electron emission are known. Thermionic emission involves an electrically charged particle emitted by an incandescent substance (as in a vacuum tube or incandescent light bulb). Photoemission releases electrons from a material by means of energy supplied by incidence of radiation, especially light. Secondary emission occurs by bombardment of a substance with charged particles such as electrons or ions. Electron injection involves the emission from one solid to another. Finally, field emission refers to the emission of electrons due to an electric field.

In field emission (or cold emission), electrons under the influence of a strong electric field are liberated out of a substance (usually a metal or semiconductor) into a dielectric (usually a vacuum). The electrons "tunnel" through a potential barrier instead of escaping "over" it as in thermionics or photoemission. Field emission is therefore a quantum-mechanics phenomena with no classical analog. A more detailed discussion of the physics of field emission can be found in U.S. Pat. No. 4,663,559 to Christensen; Cade and Lee, "Vacuum Microelectronics", *GEC J. Res. Inc.*, Marconi Rev., 7(3), 129 (1990); and Cutler and Tsong, *Field Emission and Related Topics* (1978).

The shape of a field emitter affects its emission characteristics. Field emission is most easily obtained from sharply pointed needles or tips whose ends have been smoothed into a nearly hemispherical shape by heating. Tip radii as small as 100 nanometers have been reported. As an electric field is applied, the electric lines of force diverge radially from the tip and the emitted electron trajectories initially follow these lines of force. Field emitters with such sharp features similar to a "Spindt cathode" have been previously invented. An overview of vacuum electronics and Spindt type cathodes is found in the November and December, 1989 issues of *IEEE Transactions of Electronic Devices*. Fabrication of such fine tips, however, normally requires extensive fabrication facilities to finely tailor the emitter into a conical shape. Further, it is difficult to build large area field emitters since the cone size is limited by the lithographic equipment. It is also difficult to perform fine feature lithography on large area substrates as required by flat panel display type applications. Thus, there is a need for a method of making field emitters with fine conical or pyramid shaped features without the use of lithography.

The work function of the electron emitting surface or tip of a field emitter also effects emission characteristics. The work function is defined as the difference in energies of the Fermi level and vacuum level. A smaller work function requires lower voltage to emit electrons from a surface. In a metal, the Fermi level is the same as the conduction band. In wide band gap materials, however, the Fermi level lies between the conduction band and the valence band. In such a case, the work function of the material changes as the Fermi level changes due to doping or defects. Further, the energy difference between the conduction band and vacuum level is a fundamental material property referred to as electron affinity. Thus, the work function and electron affinity are the same in a metal, but different in a wide band gap material. Recently, several wide band gap semiconductors (insulators at room temperature) such as diamond and aluminum-nitride have been shown to have negative electron affinity as well. See, for example, Yoder, "Applications of Diamond and Related Materials", *5th Annual Diamond Technology Workshop*, Troy, Mich., May 18–20, 1994; Davis, "Growth and Characterization of III-V Nitride Thin Films via Plasma-and Ion-assisted Gas-source Molecular Beam Epitaxy", *5th Annual Diamond Technology Workshop*, Troy, Mich., May 18–20, 1994; Rubin et al., "P-Type Gallium Nitride by Reactive Ion-Beam Molecular Beam Epitaxy with Ion Implantation, Diffusion or Coevaporation of Mg", pre-print by Lawrence Berkeley Laboratory, University of California, Berkeley, Calif., March 1994, pp. 1–7; and Newman et al., "Thermodynamic and Kinetic Processes Involved in the Growth of Epitaxial GaN Thin Films", *Applied Physics Letters*, 62 (11), 15 Mar. 1993, pp. 1242–1244.

There are other materials which exhibit low or negative electron affinity, but almost all of these materials are alkali metal based. Alkali metals are quite sensitive to atmospheric conditions and tend to decompose when exposed to air or moisture. Additionally, alkali metals have low melting points, typically below 1000° C., which may be unsuitable in certain applications.

For a full understanding of the prior art related to the present invention, certain attributes of diamond must also be discussed. Recently, it has been experimentally confirmed that the (111) surface of diamond crystal has an electron affinity of −0.7+/−0.5 electron-volts, showing it to possess negative electron affinity. A common conception about diamonds is that they are very expensive to fabricate. This is not always the case, however. Newly invented plasma chemical vapor deposition processes appear to be promising ways to brig down the cost of producing high quality diamond thin films. For instance, high fidelity audio speakers with diamond thin films as vibrating cones are already commercially available. It should also be noted that diamond thin films cost far less than the high quality diamonds used in jewelry.

Diamond cold cathodes have been reported by Geis et al. in "Diamond Cold Cathode", *IEEE Electron Device Letters*, Vol. 12, No. 8, Aug. 1991, pp. 456–459; and in "Diamond Cold Cathodes", *Applications of Diamond Films and Related Materials*, Tzeng et al. (Editors), Elsevier Science Publishers B.V., 1991, pp. 309–310. The diamond cold cathodes are formed by fabricating mesa-etched diodes using carbon ion implantation into p-type diamond substrates. Geis et al. indicate that the diamond can be doped either n- or p-type. In fact, several methods show promise for fabricating n-type diamond, such as bombarding the film with sodium, nitrogen or lithium during growth. However, in current practice it is extremely difficult to fabricate n-type diamond and efforts for n-type doping usually result in p-type diamond. Furthermore, p-type doping fails to take full advantage of the negative electron affinity effect, and pure or undoped diamond is insulating and normally charges up to prevent emission.

There exists a need for improved methods of making field emission areas as well as improved field emitter structures using diamond and other wide band gap materials.

SUMMARY OF THE INVENTION

The present invention field emitter includes an exposed wide band gap emission area in contact with and protruding from a substantially planar surface of a conductive metal. Suitable wide band gap materials include diamond, aluminum-nitride and gallium-nitride; suitable conductive metals include titanium, tungsten, gold and graphite. The fabrication method includes disposing the wide band gap material on a substrate, disposing the conductive metal on the wide band gap material, and etching the conductive metal to expose wide band gap emission areas. The emission areas are well suited for large area flat panel displays.

The wide band gap material of the present invention may be deposited on the substrate either as a continuous film or as a powder, followed by depositing a layer of conductive metal over the wide band gap material. Alternatively, particles of the wide band gap material and the conductive metal can be mixed in a liquid to form a colloidal solution, the solution can be coated on the substrate and then the liquid can be removed. In either case, an etch is applied to remove conductive metal thereby exposing wide band gap emission areas which contact and protrude from a substantially planar surface of the conductive metal. If desired an anneal is applied (before or after the etch) to create or enhance a low resistance electrical contact between the wide band gap material and the conductive metal.

The present invention utilizes the extraordinary properties of wide band gap materials to provide a thermally stable emission area for a field emitter.

An object of the present invention is a process for fabricating large area field emitters with sub-micron features without requiring photolithography.

Another object of the present invention is to provide a fieldtemitter which requires only a relatively small voltage for field emission to occur.

Still another object of the present invention is a process for fabricating field emitters which uses relatively few steps.

These and other objects, features and advantages of the present invention will be further described and more readily apparent from a review of the detailed description and preferred embodiments which follow.

BRIEF DESCRIPTION OF THE DRAWINGS

The following detailed description of the preferred embodiments can best be understood when read in conjunction with the following drawings, wherein:

FIG. 7 shows a cross-sectional view of the field emitter of FIG. 4, including an anode.

DETAILED DESCRIPTION OF THE PREFERRED EMBODIMENTS

Figure 1A:
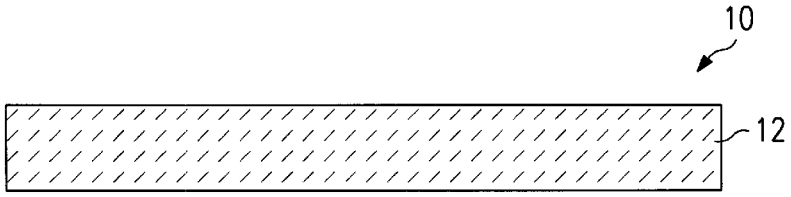
FIGS. 1A–1E show cross-sectional views of successive stages of fabricating a field emitter in accordance with one embodiment of the present invention.

While the embodiments illustrated herein disclose diamond emission areas, it is understood that the emission areas of the present invention can be formed from other wide band gap materials, such as aluminum-nitride or gallium-nitride. In wide band gap materials of the present invention, the band gap (the distance between the conduction band and valence band) is preferably in the range of approximately 2.5 to 7.0 electron volts.

Referring now to the drawings wherein depicted elements are not necessarily shown to scale and wherein like or similar elements are designated by the same reference numeral through the several views, and more particularly to FIGS. 1A–1E, there are shown successive cross-sectional views of a field emitter generally designated 10 according to a first embodiment of the invention.

With reference now to FIG. 1A, a substrate 12 is provided. Substrate 12 is preferably a flat large area substrate composed of glass or quartz, although other materials such as silicon, polymers or metals can be used. Substrate 12 provides a base upon which emission areas can be fabricated.

Figure 1B:
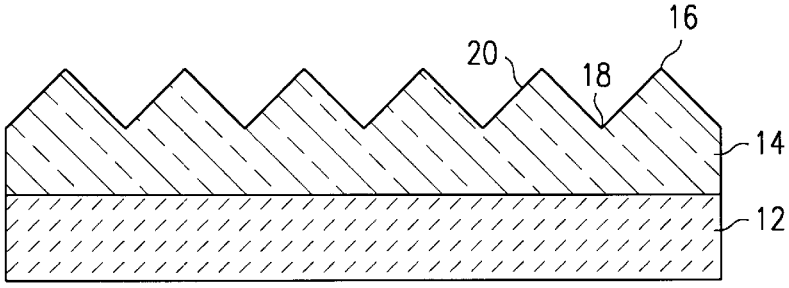

Referring now to FIG. 1B, a thin continuous film of diamond 14, preferably with low or negative electron affinity is coated on substrate 12. Diamond 14 forms a film preferably 500 to 5,000 angstroms thick which precludes the use of natural diamond. Further, diamond 14 is undoped and insulating. The preferred method of coating the thin diamond film is by chemical-vapor deposition (CVD) but other methods such as sputtering, laser deposition and ion beam deposition are also suitable. The raw materials for diamond CVD are a hydrocarbon (usually methane ($CH_4$)) and hydrogen, and diamond CVD systems are similar to standard silicon oxide CVD systems. During CVD the combination of high temperature and plasma decomposes the hydrocarbon gas and activates high energy carbon atoms. The high energy carbon atoms bombard substrate 12 and form a carbon film thereon. In addition, the high energy bombardment causes the lattice configuration of the deposited carbon atoms to change. Various carbon lattice structures, while composed of the same material, form highly differing structures, such as carbon soot, graphite, and diamond. In this embodiment, the deposited carbon atoms are bonded to four other carbon atoms. This lattice forms a diamond film on the substrate. Further details about depositing diamond films can be found in the *Journal of Materials Research*, Vol. 5, No. 11, November 1990; and U.S. Pat. Nos. 5,098,737 and 4,987,007; each of which is incorporated herein by reference. The use of diamond as a low work function material (less than 4.5 electron-volts) in field emitters is also known in the art; see, for instance, U.S. Pat. Nos. 5,199,918; 5,180,951; and 5,141,460; as well as U.S. application Ser. Nos. 08/147,700 filed Nov. 4, 1993; 08/071,157 filed Sep. 2, 1993; 07/995,846 filed Dec. 23, 1992, issued as U.S. Pat. No. 5,499,870. 07/993,863 filed Dec. 23, 1992; and 07/851,701 filed Mar. 16, 1992; each of which is incorporated herein by reference.

Diamond films can assume several orientations, such as (100), (110) and (111). The preferred orientation for diamond 14 is (111) for several reasons. The (111) orientation provides the sharpest vertical features, shown as spikes 16 surrounded by valleys 18 on top surface 20 of diamond 14. The (111) orientation also grows the fastest in the vertical direction. Moreover, it has been experimentally confirmed that the (111) surface of diamond has a negative electron affinity in the range of −1.2 to −0.2 electron-volts. Nonetheless, other orientations of diamond can be used provided the diamond contains an uneven (nonplanar) exposed top surface. The desired orientation of diamond can be obtained by applying the appropriate temperature during CVD.

The thermal conductivity of the diamond film is relatively high, for instance at least five times that of copper. However, since the diamond film contains more defects than natural diamond, the thermal conductivity of the diamond film is approximately less than half that of natural diamond. An optional adhesion layer (not shown) such as 500 angstroms titanium, chromium, tantalum, titanium-tungsten or nickel-chromium can be sandwiched between substrate 12 and diamond 14.

It is understood that diamond or other wide band gap material may be deposited on substrate 12 by any number of techniques, including sputtering, evaporation (including magnetically filtered cathode arc evaporation), laser deposition or chemical vapor deposition. The preferred technique depends on the particular material. The preferred deposition techniques for diamond films are disclosed in U.S. Pat. Nos. 5,098,737 and 4,987,007.

It is further understood that although diamond 14 is shown as deposited on-a relatively flat substrate, this need not be the case. In some applications, it may be preferable to deposit the diamond on microtips. A method of making high-density microtips using randomly dispersed nuclei as an etch mask, thereby avoiding photolithography, is disclosed in U.S. Pat. No. 5,312,514.

Figure 1C:
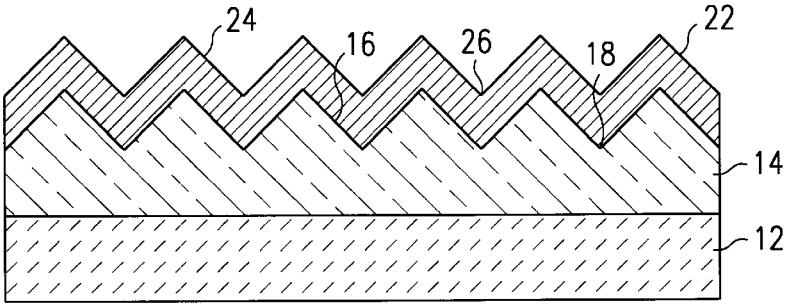

Referring now to FIG. 1C, a conductive metal is deposited over the diamond film. Sputtering and evaporation (including magnetically filtered cathode arc evaporation) are the preferred deposition techniques, with sputtering most preferred due to the low contamination and high integrity of the deposited metal. Further details of thin film technology are well known in the art; see, for instance, Maissel and Glang, *Handbook of Thin Film Technology,* 1983 Reissue, McGraw-Hill, New York N.Y. Preferred conductive metals are titanium, tungsten, gold and graphite which make good electrical contact with diamond. Graphite, for instance, has a lower sputtering yield and longer lifetime in operation than most metals. As may be seen, conductive metal 22 is deposited over diamond 14 to form a metal layer thereon wherein conductive metal portions 24 cover spikes 16 and conductive metal portions 26 cover valleys 18. Conductive metal 22 preferably forms a uniform metal coating approximately 500 to 3,000 angstroms thick.

Figure 1D:
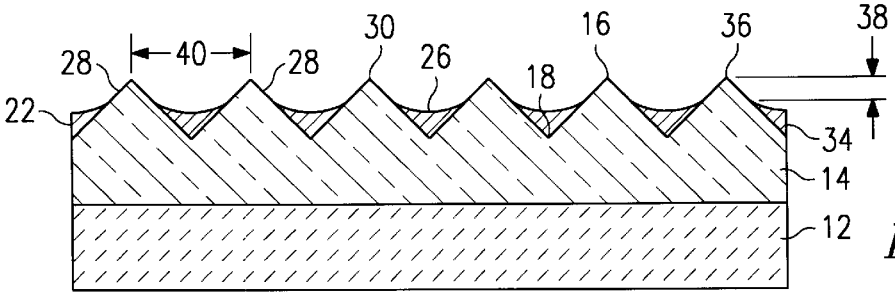

With reference now to FIG. 1D, an etch is applied to remove some but not all of conductive metal 22 in order to expose portions 28 of spikes 16 without exposing valleys 18. The exposed diamond portions 28 serve as raised field emission areas 30. Ion milling is the preferred etch for titanium, tungsten or gold, whereas plasma etching such as by hydrogen plasma is preferred for graphite due to the preferential etching of graphite with respect to diamond. Thus, ion milling, wet etching, plasma etching or a combination thereof may be used depending on the wide band gap material and conductive metal employed. Returning to the example, two important features help assure diamond emission areas 30 are exposed while at least some metal 26 remains to cover valleys 18. First, the sharpness of spikes 16 compared to the flatness of valleys 18 allows metal 24 on spikes 16 to etch at a faster rate than metal 26 on valleys 18. This results in the non-etched metal having a substantially planar top surface 34. Second, conductive metal 22 has a faster etch rate than diamond 14 to assure that the diamond protrudes above the conductive metal 22 after the etch is discontinued. For instance, when 500 electron-volts of argon ions are used for sputter etching, the sputter yield (i.e., for an incoming atom, how many atoms are etched off) of diamond is 0.12 as compared to 0.51 for titanium and 1.18 for chromium.

Endpoint detection may be performed by monitoring the optical emission from the field emitter as etching occurs. For example, bombarding diamond with electrons may produce a blue glow which can be used to indicate that the emission areas are sufficiently exposed at which time the etch can be discontinued. The exact parameters governing endpoint detection depend on factors such as the composition and shape of the wide band gap material, the conductive metal, the type of etch employed, and the desired height of the emission areas. However, for a given application these parameters can be empirically determined by one skilled in the art without undue experimentation.

When the etching is finished, emission areas 30 with peaks 36 protrude above non-etched metal top surface 34 by a height 38 less than the mean free path of electrons in diamond 14 to assure the desired field emission can later occur. That is, as long as the injection surface 34 is closer to the ejection point 36 than the mean free path of electrons in the emission area 30, then statistically the electron emission shall occur due to the ballistic tunneling of electrons through the diamond. Applicant is not aware of the mean free path for electrons in CVD diamond, but estimates the distance to be in the range of 20 to 50 angstroms, which encompasses most materials, and almost certainly in the range of 10 to 100 angstroms. Therefore, vertical distance 38 is preferably no larger than 50 angstroms, more preferably no larger than approximately 20 angstroms, and most preferably no larger than approximately 10 angstroms. The horizontal space 40 between peaks 36 is preferably less than 1 micron, thus providing fine features with high emission area density that are difficult to realize with photolithography based processes.

Figure 1E:
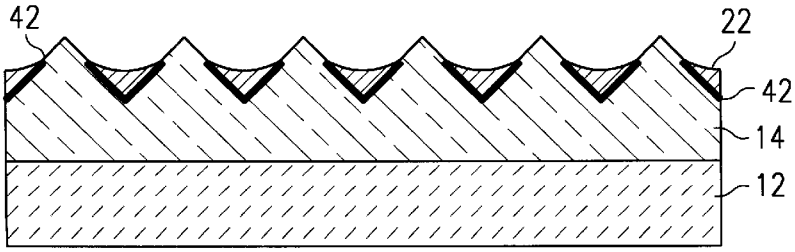

Referring now to FIG. 1E, it is critical that a low resistance electrical connection between the conductive metal 22 and diamond 14 be formed since higher contact resistance generates greater heat during field emission operation. A low resistance electrical contact may arise during the step of depositing metal 22 on diamond 14, particularly if titanium, tungsten or gold is sputter deposited. However, if a low resistance electrical contact is not present, or if a better electrical contact is desired, then an annealing step either before or after the etching step may be advantageous. For instance, field emitter 10 can be subjected to a 400° C. to 500° C. bake for approximately 10 minutes. This forms a 10 angstrom thick alloy 42 of diamond 14 and conductor 22 at the interface therebetween. Alloy 42 assures a low resistance electrical contact between diamond 14 and conductor 22.

Figure 2:
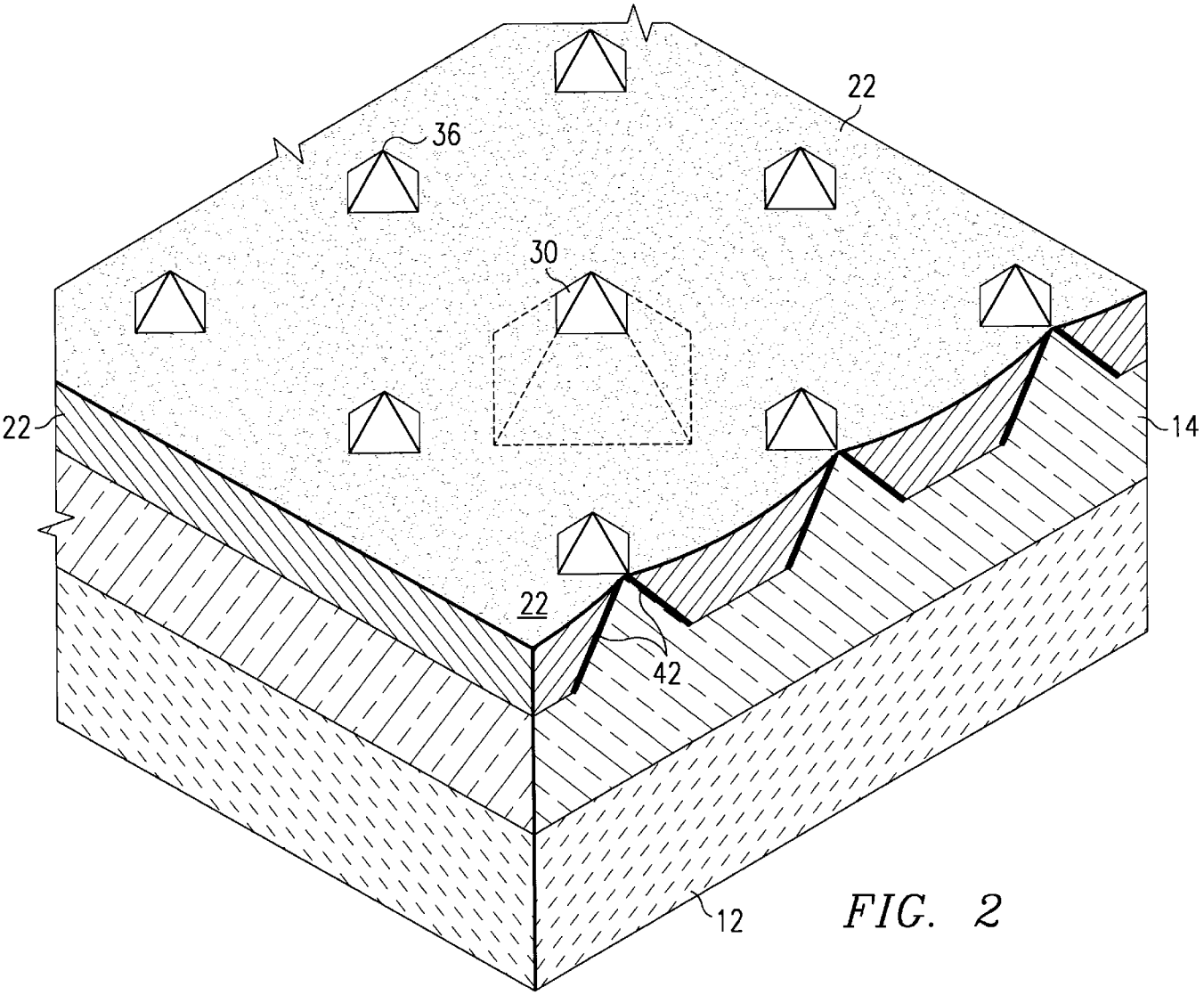
FIG. 2 shows an elevational perspective view of the field emitter of FIGS. 1A–1E, FIGS. 3A–3E show cross-sectional views of successive stages of fabricating a field emitter in accordance with another embodiment of the present invention.

Referring now to FIG. 2, there is seen a perspective view of the field emitter 10 after the fabrication of FIGS. 1A–1E is completed.

With reference now to FIGS. 3A–3E, there are shown successive cross-sectional views of field emitter 10 according to another embodiment of the invention. In this embodiment, separate particles of diamond are deposited on the substrate. In other respects, this embodiment is similar to the embodiment of FIGS. 1A–1E as previously described.

Figure 3A:
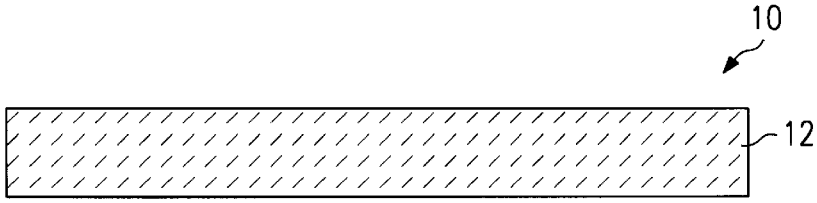
Figure 3B:
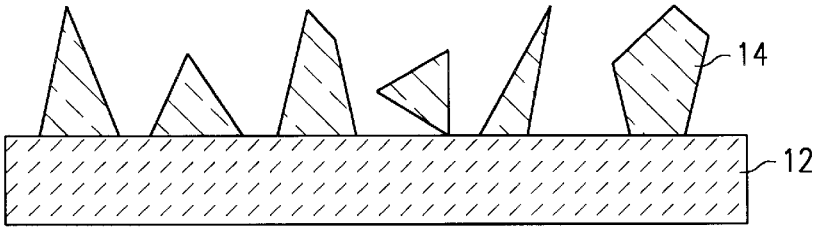
Figure 3C:
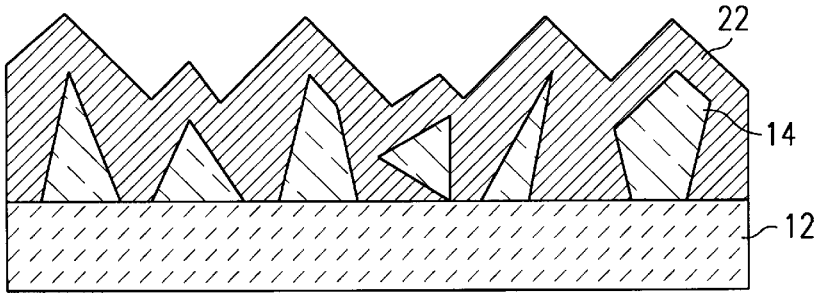
Figure 3D:
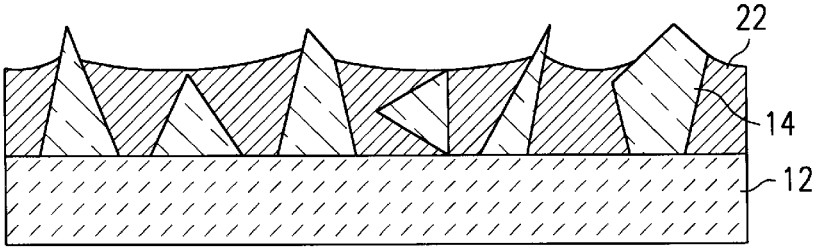
Figure 3E:
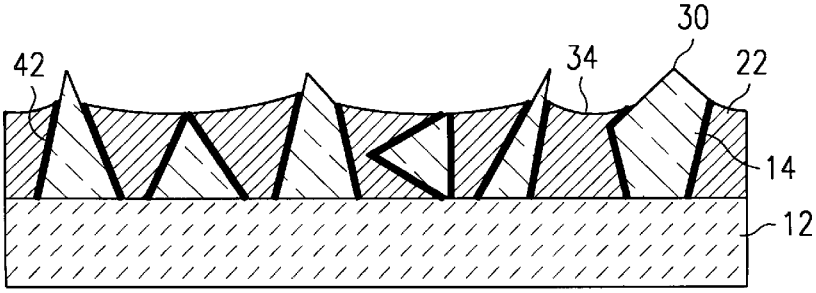

Referring now to FIG. 3A, substrate 12 is provided as previously described. In FIG. 3B, separate spaced particles of diamond 14 (such as diamond powder) are deposited on substrate 12. The size of the particles is preferably in the range of 20 angstroms to 100 microns. It is noted that substantially all the particles of diamond 14 may be spaced from the other particles (as shown), or, alternatively, substantially all the particles may be in contact with the other particles (not shown). In either case, it may be desirable to apply ultrasonic agitation to the substrate in order to more evenly distribute the particles thereby increasing the uniformity of the top surface of diamond 14. In FIG. 3C, a conductive metal is deposited on the diamond particles as previously described. Finally, in FIG. 3D an etch is applied as previously described thereby forming emission areas 30 which protrude above non-etched metal top surface 34, and in FIG. 3E the field emitter is annealed as previously described thereby forming alloy 42 between the diamond and the conductive metal.

Figure 4:
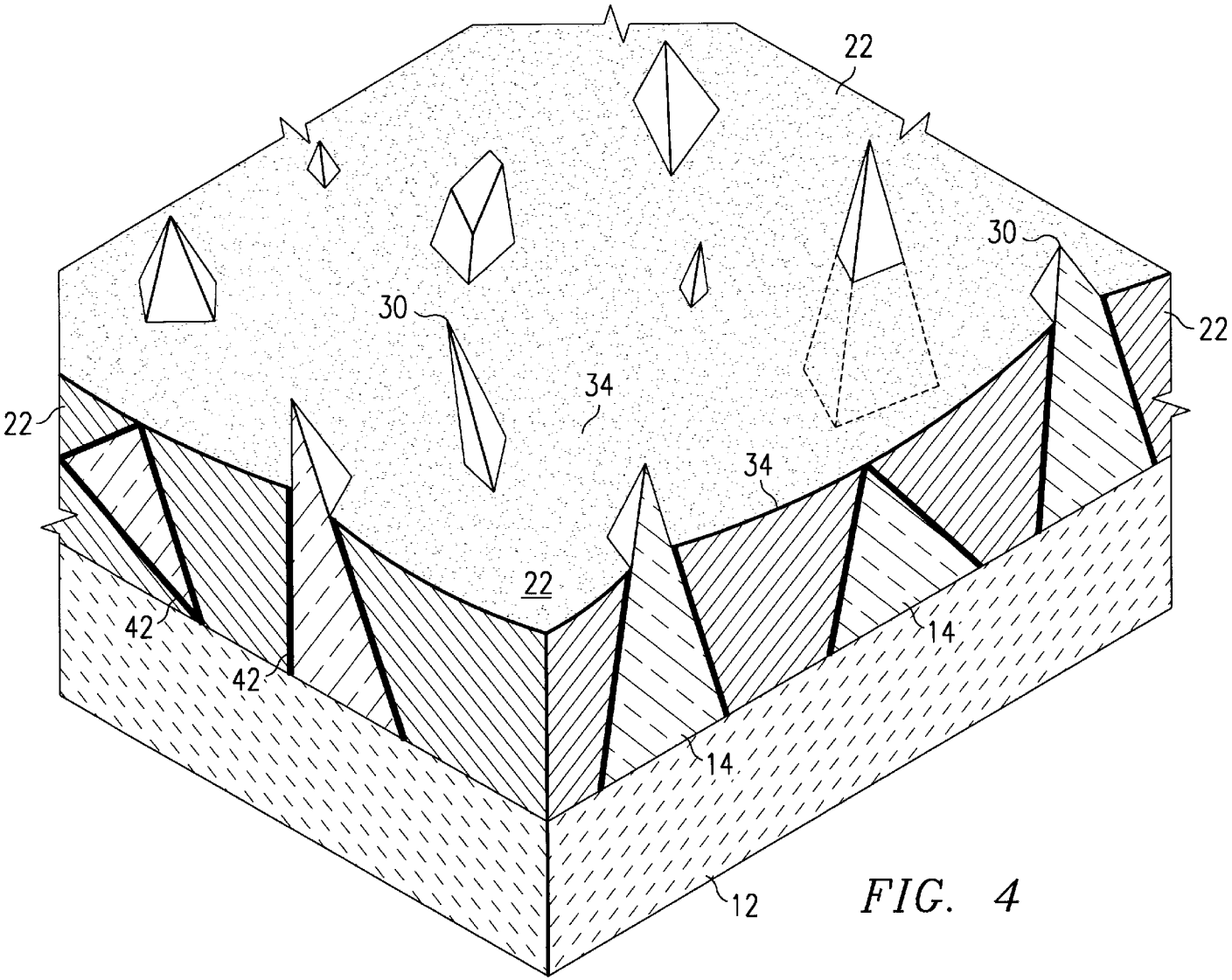
FIG. 4 shows an elevational perspective view of the field emitter of FIGS. 3A–3E, FIGS. 5A–5E show cross-sectional views of successive stages of fabricating a field emitter in accordance with still another embodiment of the present invention.

Referring now to FIG. 4, there is seen a perspective view of the field emitter 10 after the fabrication of FIGS. 3A–3E is completed.

With reference now to FIGS. 5A–5E, there are shown successive cross-sectional views of field emitter 10 according to still another embodiment of the invention. In this embodiment, particles of diamond and conductive metal are mixed with a liquid to form a colloidal solution. The colloidal solution is deposited on the substrate and then the liquid is removed, thereby disposing the diamond and conductive metal on the substrate. In other respects, this embodiment is similar to the embodiment of FIGS. 1A–1E as previously described.

Figure 5A:
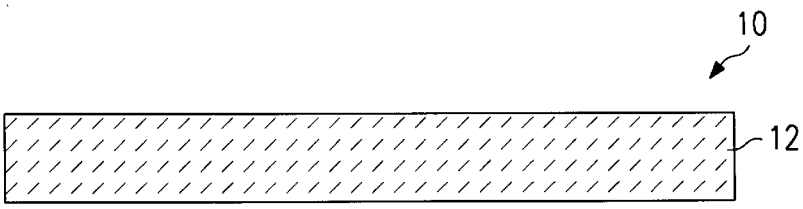
Figure 5B:
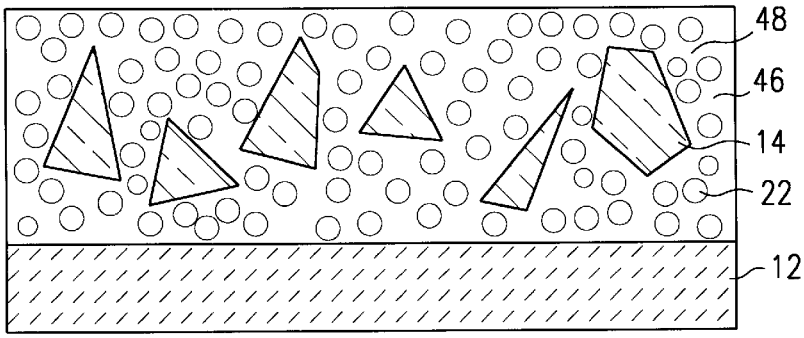
Figure 5C:
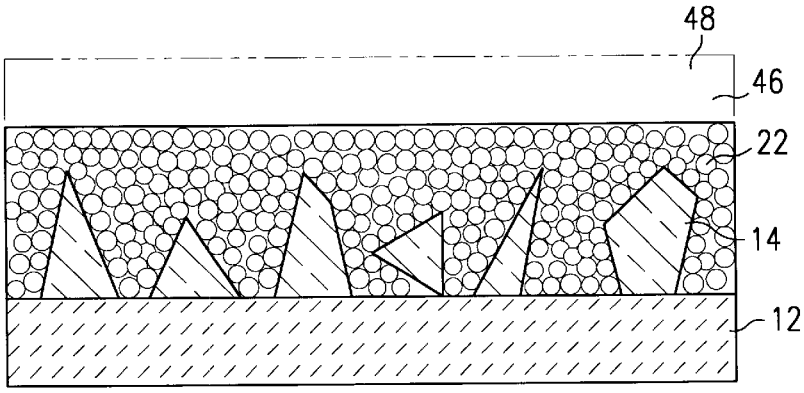
Figure 5D:
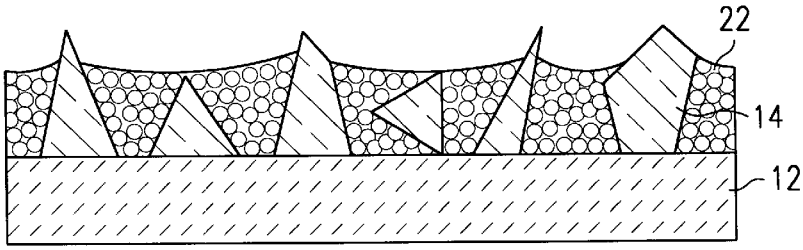
Figure 5E:
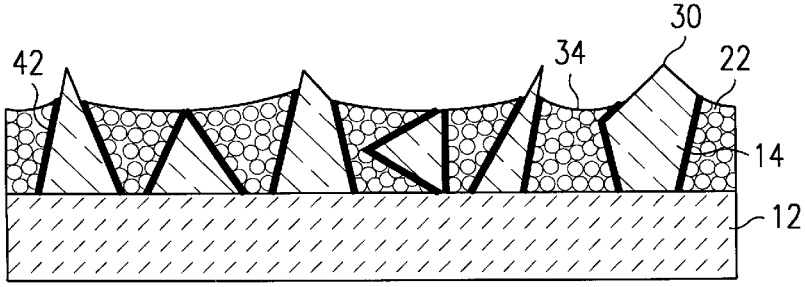

Referring now to FIG. 5A, substrate 12 is provided as previously described. In FIG. 5B, separate spaced particles of diamond 14 (such as diamond powder) are mixed with particles of conductive metal 22 (such as conductive metal powder) in a liquid 46 such as isopropyl alcohol to form a colloidal solution 48 with particles of diamond and conductive metal suspended therein. The size of the diamond particles is preferably in the range of 20 angstroms to 100 microns; the size of the conductive metal particles is also preferably in the range of 20 angstroms to 100 microns. It is noted that particles of diamond 14, particles of conductive metal 22, and liquid 46 may be mixed in any order. For example, particles of diamond 14 can be mixed in an organometallic liquid such as copper hexafluoroacetylacetonate to form colloidal solution 48. In FIG. 5C, colloidal solution 48 is deposited or coated such as by spin-coating on substrate 12, and the liquid is removed thereby embedding diamond 14 in conductive metal 22. Preferably, liquid 46 is evaporated at a relatively low temperature. For instance, isopropyl alcohol can evaporate at room temperature, and likewise the organic component of an organometallic liquid can often be evaporated at or below 600° C. Evaporating the liquid at a temperature above room temperature may improve the adhesion between the conductive metal and diamond particles and an optional adhesion layer. Finally, in FIG. 5D an etch is applied as previously described thereby forming emission areas 30 which protrude above non-etched metal top surface 34, and in FIG. 5E the field emitter is annealed as previously described thereby fusing the conductive metal particles and forming alloy 42 between the diamond and the conductive metal.

Figure 6:
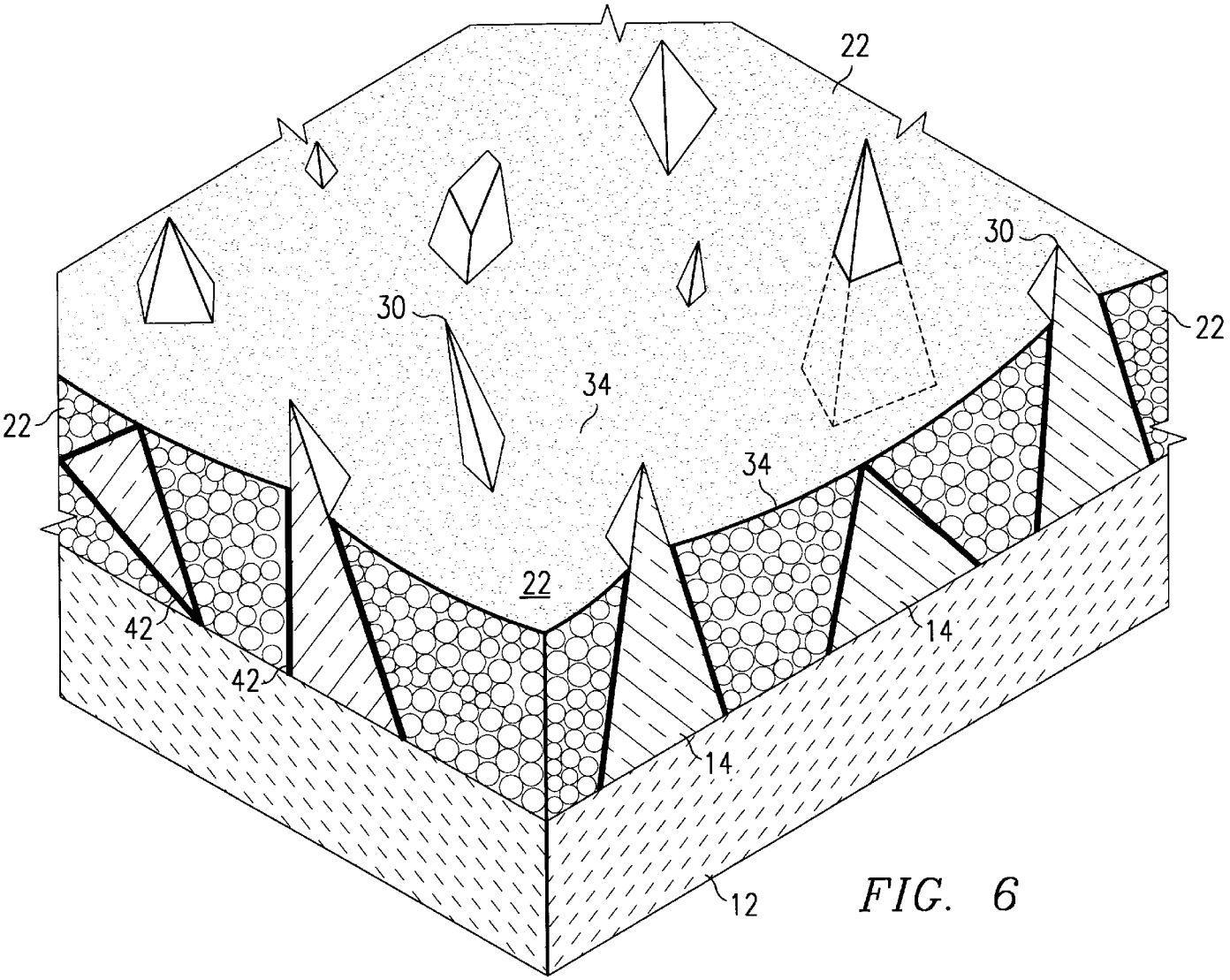
FIG. 6 shows an elevational perspective view of the field emitter of FIGS. 5A–5E.

Referring now to FIG. 6, there is seen a perspective view of the field emitter 10 after the fabrication of FIGS. 5A–5E is completed.

As configured, the emission areas of the present invention can be used in a field emitter device by constructing an anode. The details of anode construction would be apparent to one skilled in the art, see, for instance, U.S. Pat. No. 5,019,003. Referring to FIG. 7, anode 50 is positioned in such a field emitter device to receive electrons from the field emitter 10 under the influence of a positive bias imposed therebetween by voltage source 60. The emission areas of the present invention are particularly well suited for operation in large area flat panel displays.

Other such possibilities should readily suggest themselves to persons skilled in the art. For example, the emission areas of the present invention may be sharp tips, or relatively flat, as long as they protrude above the conductive metal. The present invention may suitably comprise, consist essentially of or consist of the foregoing materials and process steps.

The present invention; therefore, is well adapted to carry out the objects and attain the ends and advantages mentioned, as well as others inherent therein. While presently preferred embodiments of the present invention have been described for the purpose of disclosure, numerous other changes in the details of construction, arrangement of parts, compositions and materials selection, and processing steps can be carried out without departing from the spirit of the present invention which is intended to be limited only by the scope of the appended claims.

What is claimed is:

1. A method of emitting electrons from a field emitter, comprising the steps of:

passing electrons from a conductive metal into an exposed wide band gap emission area in contact with and protruding from a substantially planar surface of the conductive metal;

applying a voltage to the conductive metal to force the electrons in the conductive metal to ballistically tunnel through the emission area; and emitting the electrons from the emission area by field emission.

2. The method of claim 1 wherein the emission area has a band gap in the range of approximately 2.5 to 7.0 electron-volts.

3. The method of claim 1 wherein the emission area is an insulator selected from the group consisting of diamond, aluminum-nitride and gallium-nitride.

4. The method of claim 1 wherein the emission area protrudes a height above the surface of the conductive metal less than the mean free path of electrons in the emission area.

5. The method of claim 1 wherein the conductive metal is selected from the group consisting of titanium, tungsten, gold and graphite.

6. A field emitter, comprising:

a conductive metal; and an exposed emission area composed entirely of wide band gap material in contact with and protruding from a substantially planar surface of the conductive metal.

7. The field emitter of claim 6 wherein the emission area extends from a continuous film of the wide band gap material beneath the conductive metal.

8. The field emitter of claim 6 wherein the emission area extends from a particle of wide band gap material embedded in the conductive metal.

9. The field emitter of claim 6 further comprising a substrate beneath the wide band gap material.

10. The field emitter of claim 6 wherein the emission area has a band gap in the range of approximately 2.5 to 7.0 electron-volts.

11. The field emitter of claim 6 wherein the emission area is an insulator.

12. The field emitter of claim 6 wherein the emission area is selected from the group consisting of diamond, aluminum-nitride and gallium-nitride.

13. The field emitter of claim 6 wherein the emission area protrudes a height above the conductive metal less than the mean free path of electrons in the wide band gap material.

14. The field emitter of claim 13 wherein the eight is in the range of approximately 10 to 100 angstroms.

15. The field emitter of claim 6 wherein the conductive metal is selected from the group consisting of titanium, tungsten, gold and graphite.

16. The field emitter of claim 6 wherein the conductive metal annealed to the emission area.

* * * * *